US009088061B2

(12) United States Patent
Balijapalli et al.

(10) Patent No.: US 9,088,061 B2
(45) Date of Patent: Jul. 21, 2015

(54) HIGH DIRECTIVITY DIRECTIONAL COUPLER HAVING STAGES OPERATING OVER RESPECTIVE FREQUENCY RANGES AND A SWITCH FOR SELECTING A DESIRED FREQUENCY RANGE

(71) Applicants: Kameswara Rao Balijapalli, Chennai (IN); Ravi Kishore, Chennai (IN); Kumaralingam Ramamoorthy, Chennai (IN); Karthikeyan Shanmugavelu, Chennai (IN); Deepa Vedhanayagam, Chennai (IN)

(72) Inventors: Kameswara Rao Balijapalli, Chennai (IN); Ravi Kishore, Chennai (IN); Kumaralingam Ramamoorthy, Chennai (IN); Karthikeyan Shanmugavelu, Chennai (IN); Deepa Vedhanayagam, Chennai (IN)

(73) Assignee: HCL Technologies Limited, Chennai, Tamil Nadu (IN)

( * ) Notice: Subject to any disclaimer, the term of this patent is extended or adjusted under 35 U.S.C. 154(b) by 201 days.

(21) Appl. No.: 13/723,225

(22) Filed: Dec. 21, 2012

(65) Prior Publication Data

US 2014/0176255 A1 Jun. 26, 2014

(51) Int. Cl.
*H01P 5/18* (2006.01)

(52) U.S. Cl.
CPC ..... *H01P 5/184* (2013.01)

(58) Field of Classification Search
CPC ..... H01P 5/18; H01P 5/182; H01P 5/184
USPC ..... 333/109, 110, 111, 116
See application file for complete search history.

(56) References Cited

U.S. PATENT DOCUMENTS 5,055,807 A * 10/1991 Oldfield ..... 333/110
7,671,699 B2 * 3/2010 Wren ..... 333/109

* cited by examiner

*Primary Examiner* — Benny Lee

(57) ABSTRACT

The directional coupler supports ultra high bandwidth of 5600 MHz (from 400 MHz to 6 GHz) in compact structure and also provides high directivity of (>15 dB). The coupler uses a two stage micro-strip directional coupler for a frequency range of 400 MHz to 6 GHz, where the first stage supports a frequency of operation from 0.4 GHz to 1 GHz and the second stage supports a frequency of operation from 1 GHz to 6 GHz and the required coupled port can be chosen using a radio frequency switch as required by the application used in.

3 Claims, 6 Drawing Sheets

HIGH DIRECTIVITY DIRECTIONAL COUPLER HAVING STAGES OPERATING OVER RESPECTIVE FREQUENCY RANGES AND A SWITCH FOR SELECTING A DESIRED FREQUENCY RANGE

The present application is based on, and claims priority from, IN Application Number 2421/CHE/2012, filed on 19 Jun. 2012, the disclosure of which is hereby incorporated by reference herein.

TECHNICAL FIELD

This embodiment relates to wideband directional coupler and more particularly to a compact directional coupler with high directivity and capable of operating on ultra-high bandwidth.

BACKGROUND

Directional couplers are passive radio frequency components used in radio frequency and microwave signal routing for isolating, separating or combining signals. With advances in telecommunications and wireless technologies, directional couplers are required to support wide bandwidth, have high directivity, better coupling and provide better isolation. Micro strip based directional couplers have proven to be compact with ease to integrate and hence popular.

However, in most directional couplers, there is a trade-off between bandwidth, directivity and compactness. This trade off works satisfactorily in case of narrow band or for extremely high frequencies and provides high directivity along with compactness.

SUMMARY OF THE INVENTION

Accordingly the embodiment provides a compact micro strip directional coupler providing high directivity and capable of operating over an ultra-high bandwidth comprising of a first stage and second stage coupler. The first stage coupler operates over a frequency range of 0.4 GHz. to 1 GHz. The second stage coupler operates over a frequency range of 1 GHz to 6 GHz. A radio frequency switch is used to select between the first stage coupled port and second stage coupled port based on the input frequency.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE FIGURES

This embodiment is illustrated in the accompanying drawings, throughout which like reference letters indicate corresponding parts in the various figures. The embodiments herein will be better understood from the following description with reference to the drawings, in which.

DETAILED DESCRIPTION OF PREFERRED EMBODIMENTS

Figure 1:
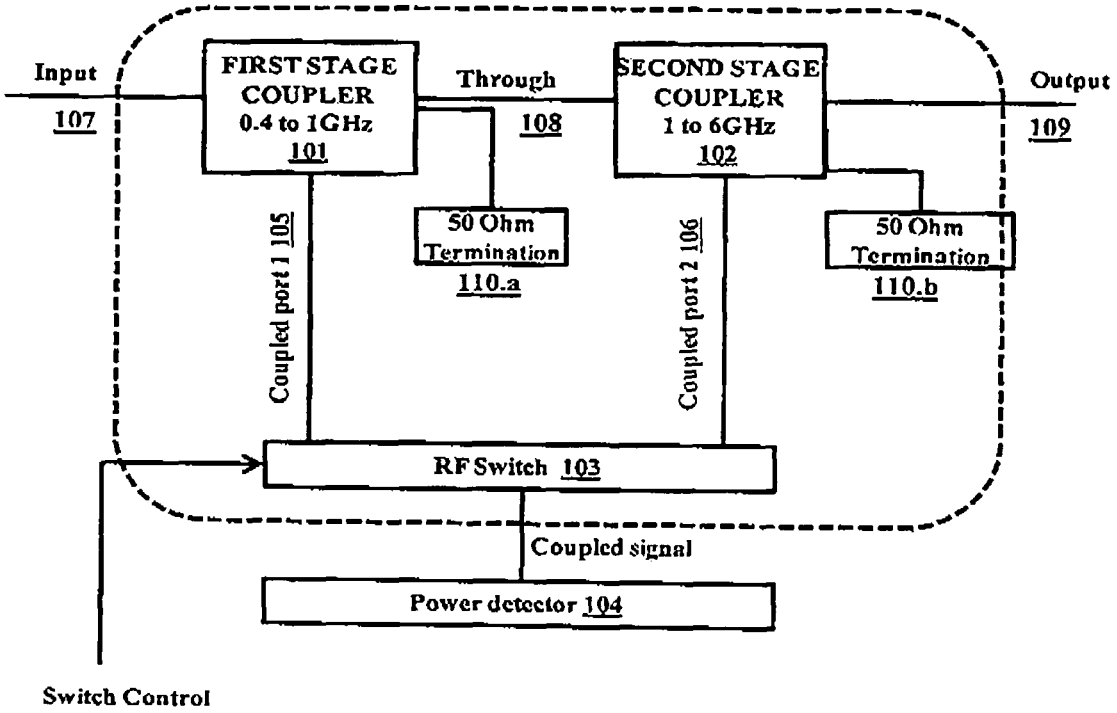
FIG. 1 illustrates a block diagram of the micro strip directional coupler, according to the embodiments as disclosed herein.

The embodiments herein, the various features, and advantageous details thereof are explained more fully with reference to the non-limiting embodiments that are illustrated in the accompanying drawings and detailed in the following description. Descriptions of well-known components and processing techniques are omitted to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Referring now to the drawings, and more particularly to FIGS. 1 through 5, 6*a* and 6*b*, where similar reference characters denote corresponding features consistently throughout the figures, there are shown preferred embodiments. Definitions of terms used throughout the specification are given below:

Directivity: The difference in dB of the power output at a coupled port, when a certain amount of power is transmitted in the desired direction, to the power output at the same coupled port when the same amount of power is transmitted in the opposite direction. Reflectionless terminations are connected to all ports.

Insertion loss: The change in load power, due to the insertion of the coupler in a transmission system, with reflectionless terminations connected to the ports of the coupler. Insertion loss is expressed in dB and is defined as 10*log(Po/Pi) where Po=Power Out and Pi=Power In.

Coupling: Coupling (coefficient) is the ratio in dB of the incident power fed into the main port to the coupled port power when all ports are terminated by reflectionless terminations.

Return loss: Return loss at any port of a coupler is specified for the case of reflectionless terminations at all other ports. As with any device, return loss is a measure of the quality of match relative to given characteristic impedance.

Isolation: Isolation of a directional coupler can be defined as the difference in signal levels, in dB, between the input port and the isolated port when the two other/output ports are terminated by matched loads.

FIG. 1 illustrates a block diagram of an integrated micro strip directional coupler, according to the embodiments as disclosed herein. The integrated directional coupler comprises of multiple stages of directional couplers. The first stage directional coupler 101 operates over a frequency range of 0.4 GHz to 1 GHz and the second stage directional coupler

102 operates over a frequency range of 1 GHz to 6 GHz. The coupled port 1 105 and the coupled port 2 106 of the integrated directional coupler both connect to an RF switch 103, wherein the RF switch 103 is in turn controlled by a switch control. The figure shows an example application of a power detector 104 connected to the RF switch 103. Appropriate 50 Ohms terminations, as shown in 110.*a* and 110.*b* are connected to the isolation ports are also shown in the FIGURE. As per the system need say for power detection, if the coupled signal from 0.4 GHz to 1 GHz is required, the coupled signal from the first stage of the coupler 101 can be routed to the Power detector 104 using the RF Switch 103. Similarly, if the coupled signal from 1 GHz to 6 GHz is required, the coupled signal from the second stage of the coupler 102 will be routed to the power detector 104 using the RF switch 103. Thus, the coupler could satisfactorily work for the broadband of 0.4 GHz to 6 GHz. The RF switch can be controlled using an external control designated by "Switch Control". The directional coupler supports ultra high bandwidth of 5600 MHz (from 400 MHz till 6 GHz) in compact structure and also provide high directivity of >15 dB. The directional coupler is compact enough and is suitable to be incorporated as a Monolithic Microwave Integrated Circuit (MMIC). The compactness in size is achieved using unique approach of combining the two stages. The realizable physical size is approximately 27 mm*51 mm*1.6 mm. An input 107 for transmission of input frequencies to the system, a through 108 for carrying the frequency through to the second stage coupler and an output 109 for transmission of output from the system are also shown in FIG. 1.

Figure 2:
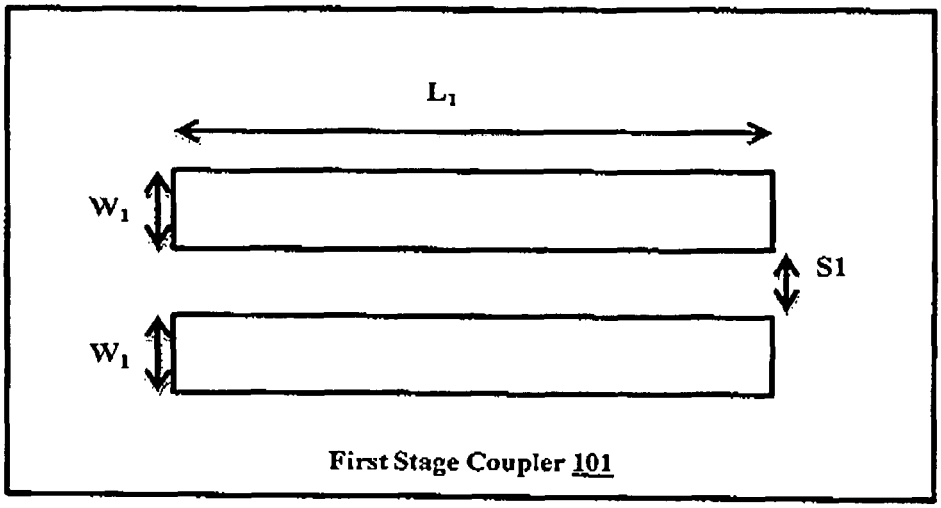
FIG. 2 shows the first stage directional coupler, according to embodiments disclosed herein.

FIG. 2 shows the first stage directional coupler, according to embodiments disclosed herein. The first stage directional coupler 101 comprises of a single section—20 dB coupled line coupler and is designed with meandered structure over the frequency range of 0.4 GHz to 1 GHz. This frequency range has been found to be a suitable option for achieving the design target. The dimensions of the micro strip-coupled lines are W1, S1 and L1. The values of W1, S1 and L1 are chosen based on results required. The upper arm receives the wideband input and acts as a through arm, while the lower produces the coupled output.

Figure 3:
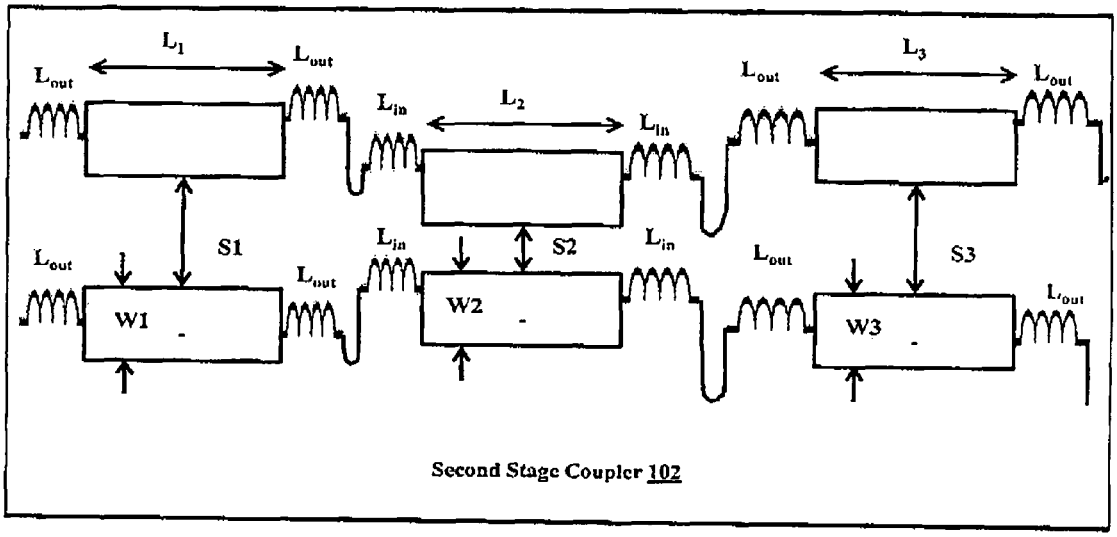
FIG. 3 shows the second stage directional coupler, according to embodiments disclosed herein.

FIG. 3 shows the second stage directional coupler, according to embodiments disclosed herein. For the second stage coupler 102 operating over 1 GHz to 6 GHz, a three section −20 dB maximally flat couplers design based on quadrupled inductive compensated micro strip coupled lines is used for directivity improvement. The required optimum Inductor for the inner and outer coupled-Line section are $L_{in}$ and $L_{out}$. The dimensions of the micro strip coupled lines for the first and the third sections are found to be W1, S1 and L1 and W3, S3 and L3, respectively. The dimension of the micro strip couple lines for the second section is W2, S2 and L2.

As two separate stages supporting 400 MHz to 1000 MHz and 1000 MHz to 6000 MHz are combined, the required coupled port can be chosen using switch. A high directivity of 15 dB is achieved using the integrated approach for ultrawide bandwidth of 5600 MHz. The compact, ultra high-bandwidth and high directivity micro strip directional coupler is majorly applicable in broadband transceivers/broadband transmitters/broadband receivers. In these systems, the embodiment can be used as the major component in signal/power detection circuitry.

Figure 4:
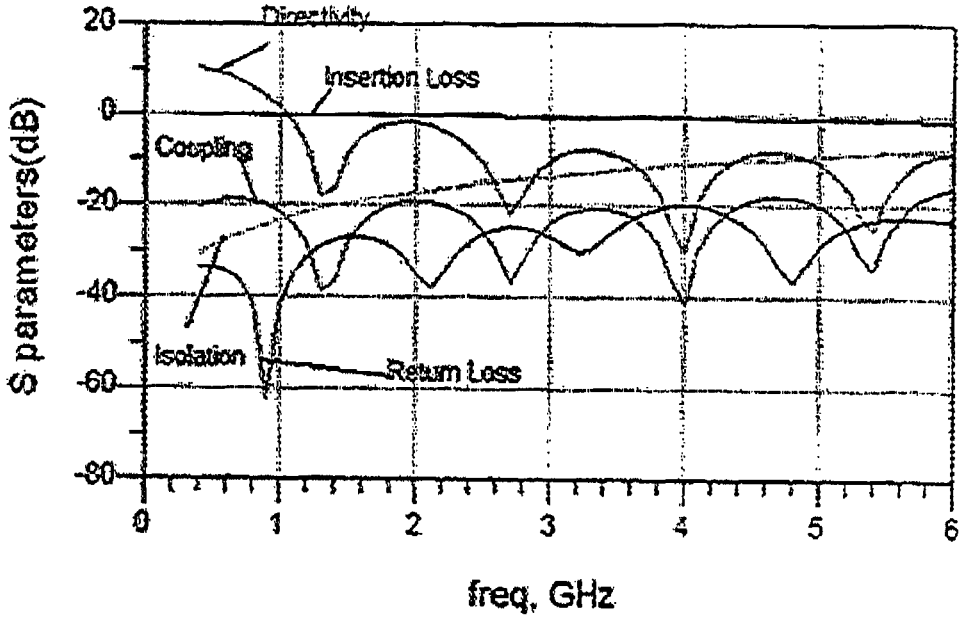
FIG. 4 shows the simulated s-parameters of first stage coupler operating over 0.4 GHz to 1 GHz result simulated over 0.4 GHz to 6 GHz, according to embodiments disclosed herein.

FIG. 4 shows the s-parameters in dB of first stage coupler operating over a frequency range of 0.4 GHz to 1 GHz simulated over 0.4 GHz to 6 GHz, according to embodiments disclosed herein.

Figure 5:
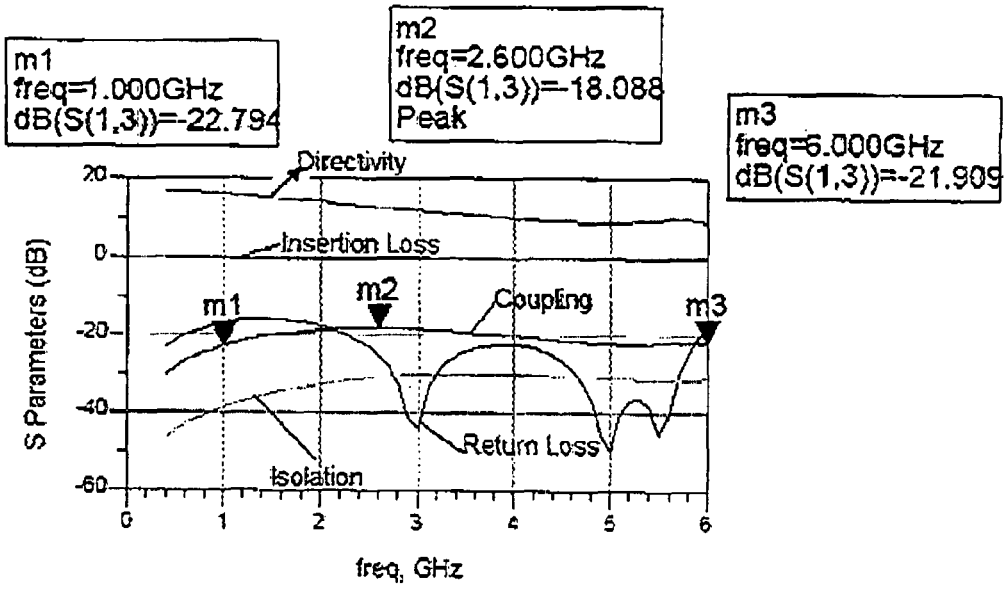
FIG. 5 shows the simulated s-parameters of second stage coupler operating over 1 GHz to 6 GHz result simulated over 0.4 GHz to 6 GHz, according to embodiments disclosed herein.

FIG. 5 shows the s-parameters in dB of second stage coupler operating over a frequency range of 1 GHz to 6 GHz simulated over 0.4 GHz to 6 GHz, according to embodiments disclosed herein. Also given are coupled signal magnitude at frequency=1000 GHz (m1) shows dB(S(1,3))=−22.794, coupled signal magnitude at frequency=2.600 GHz (m2) shows dB(S(1,3))=−18.088, and coupled signal magnitude at frequency=6.000 GHz (m3) shows dB(S(1,3))=−21.909, according to embodiments disclosed herein.

Figure 6A:
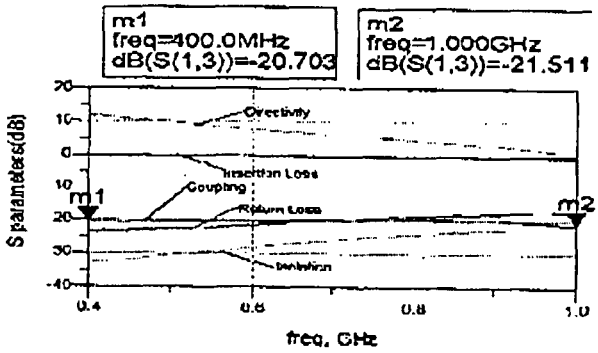
FIGS. 6*a* and 6*b* show the simulated s-parameters of integrated coupler operating over 0.4 GHz to 6 GHz, using the first stage and second stage couplers respectively according to embodiments disclosed herein.
Figure 6B:
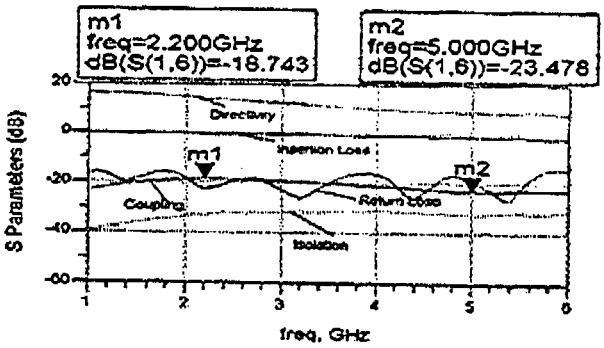

FIGS. 6*a* and 6*b* show the simulated s-parameters in dB of integrated coupler operating over 0.4 GHz to 6 GHz; using the first stage and second stage couplers respectively, according to embodiments disclosed herein. The results are captured at respective coupler stages using the RF switch. In FIG. 6*a*, given are coupled signal magnitude at frequency=0.4 GHz (m1) showing dB(S(1,3))=−20.703 and coupled signal magnitude at frequency=1.000 GHz (m2) showing dB(S(1,3))=−21.511. In FIG. 6*b*, given are coupled signal magnitude at frequency=2.200 GHz (m1) showing dB(S(1,6))=−18.743 and coupled signal magnitude at frequency=5.000 GHz (m2) showing dB(S(1,6))=−23.478.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

We claim:

1. A compact integrated broadband micro strip directional coupler providing high directivity, said coupler comprising:

a first stage coupler operating at a low frequency signal range of 0.4 GHz to 1 GHz;

a second stage coupler operating at a high frequency signal range of 1 GHz to 6 GHz; and a radio frequency switch to select coupled ports from each of said first stage and said second stage, wherein said radio frequency switch is configured to pass at least a coupled output, wherein said coupled output is configured to comprise at least said low frequency signal range and said high frequency signal range.

2. The compact integrated broadband micro strip directional coupler of claim 1, wherein said first stage and second stage couplers are connected through a through arm.

3. The compact integrated broadband micro strip directional coupler of claim 1, wherein said radio frequency switch selects between the first stage coupled output and second stage coupled output based on a frequency of an input signal.

* * * * *